US007503286B2

(12) United States Patent
Hiltunen et al.

(10) Patent No.: US 7,503,286 B2
(45) Date of Patent: Mar. 17, 2009

(54) METHOD OF COMBUSTING OIL SHALE IN A CIRCULATING FLUIDIZED BED BOILER

(75) Inventors: Matti Hiltunen, Karhula (FI); Pertti Kinnunen, Varkaus (FI); Juha Sarkki, Kirkkonummi (FI)

(73) Assignee: Foster Wheeler Energia Oy, Espoo (FI)

( * ) Notice: Subject to any disclaimer, the term of this patent is extended or adjusted under 35 U.S.C. 154(b) by 0 days.

(21) Appl. No.: 11/587,948

(22) PCT Filed: Jun. 29, 2004

(86) PCT No.: PCT/FI2004/000396

§ 371 (c)(1),
(2), (4) Date: Aug. 1, 2007

(87) PCT Pub. No.: WO2005/106325

PCT Pub. Date: Nov. 10, 2005

(65) Prior Publication Data

US 2007/0272171 A1 Nov. 29, 2007

(30) Foreign Application Priority Data

Apr. 29, 2004 (EE) ..... 200400082

(51) Int. Cl.
*F23C 10/02* (2006.01)

(52) U.S. Cl. ..... 122/4 D; 432/15

(58) Field of Classification Search ..... 432/15; 122/4 D; 165/104.16
See application file for complete search history.

(56) References Cited

U.S. PATENT DOCUMENTS 4,308,806 A 1/1982 Uemura et al. ..... 110/244
4,373,454 A 2/1983 Pitrolo et al. ..... 110/347
4,413,573 A 11/1983 Hall et al. ..... 110/347
4,817,563 A 4/1989 Beisswenger et al. ..... 122/4 D (Continued)

FOREIGN PATENT DOCUMENTS

EP 0 766 041 A1 4/1997

OTHER PUBLICATIONS

International Search Report dated Nov. 26, 2004, which issued in corresponding International Application No. PCT/FI2004/000396.

(Continued)

*Primary Examiner*—Gregory A Wilson
(74) *Attorney, Agent, or Firm*—Fitzpatrick, Cella, Harper & Scinto

(57) ABSTRACT

A method of combusting oil shale in a circulating fluidized bed boiler. Fuel, including oil shale, is introduced into a furnace of the circulating fluidized bed boiler, primary oxygenous gas is introduced through a bottom grid of the furnace, and secondary oxygenous gas is introduced to the furnace at a first level above the level of the bottom grid. The primary oxygenous gas is introduced to the furnace at a rate providing below the first level a fluidizing velocity of less than 2.5 m/s, and the primary and secondary oxygenous gases are introduced to the furnace in such a way that a circulating fluidized bed is formed, and the fluidizing velocity at the first level is less than 70% of the fluidizing velocity in the upper portion of the furnace.

9 Claims, 1 Drawing Sheet

U.S. PATENT DOCUMENTS

| | | | | | |
|---|---|---|---|---|---|
| 4,843,981 | A | | 7/1989 | Goldbach et al. | 110/347 |
| 5,006,062 | A | | 4/1991 | Lee et al. | 432/14 |
| 5,344,629 | A | | 9/1994 | Engstrom | 423/239.1 |
| 5,967,098 | A | * | 10/1999 | Tanca et al. | 122/4 D |
| RE37,300 | E | * | 7/2001 | Nagato et al. | 122/4 D |
| 6,279,513 | B1 | * | 8/2001 | Virr | 122/4 D |
| 6,389,995 | B1 | | 5/2002 | Adams et al. | 110/245 |

OTHER PUBLICATIONS

Written Opinion of the International Searching Authority mailed Dec. 6, 2004, issued in International Application No. PCT/FI2004/000396.

Notification of Transmittal of the International Preliminary Report on Patentability mailed Jul. 27, 2006, issued in International Application No. PCT/FI2004/000396.

* cited by examiner

METHOD OF COMBUSTING OIL SHALE IN A CIRCULATING FLUIDIZED BED BOILER

This application claims foreign priority based on Finnish Patent Application No. P2004-00082, filed Apr. 29, 2004, and PCT patent application publication number PCT/FI2004/000396, filed Jun. 29, 2004, which are each hereby incorporated by reference herein.

BACKGROUND OF THE INVENTION

The present invention relates to the combustion of oil shale in a circulating fluidized bed (CFB) boiler.

In the furnace of a CFB boiler, carbonaceous fuel, such as coal or biofuel, is combusted in a bed of inert material, such as sand, and fluidized oxygenous gas, usually air. The upward velocity of the fluidizing gas in the furnace is usually 5-10 m/s, so as to perform the combustion in a vigorously turbulent bed of particles entrained with the fluidizing gas. Most of the particles escaping from the furnace of a CFB boiler with the flue gas produced in the furnace are separated from the flue gas, usually in a cyclone separator, and are returned to the lower portion of the furnace.

Oil shale, found, for example, in Estonia, the Middle East and North Africa is a special kind of carbonaceous fuel. It comprises 25-40% fossil organic material, in dry mass, with the rest being mineral material having calcium carbonate as the main component. The organic material comprises 85-90% of combustible, volatile matter, and typically, about 1.8% of sulfur and 0.75% of chlorine. Due to the chlorine, combustion of oil shale suffers from the generation of high corrosion. Another problem related to oil shale is that it is very friable, producing a high amount of fly ash, which tends to foul the heat transfer surfaces in the flue gas path.

Usually, in CFB boilers, only a portion of the combusting air is introduced as primary air through the bottom grid of the furnace. The rest of the oxygen needed for the combustion is introduced as secondary air at higher levels in the furnace, usually 2-6 m above the bottom grid.

The split between primary air and secondary air depends on the type of fuel. When combusting typical fossil fuels, such as bituminous coal, the proportion of primary air is usually from about 55% to about 65%. With lignite and biofuels, the proportion of primary air is usually about 55%, or as low as 40%, if limestone is introduced to the furnace for reducing sulfur oxide emissions.

According to a commonly used design, the bottom section of the furnace of a CFB boiler is downwards tapering so as to maintain an approximately uniform fluidizing velocity at all levels of the boiler, despite the fact that a part of the combustion air is introduced as a secondary air. Correspondingly, the grid area of the furnace varies typically between 40% and 55% of the cross-sectional area of the furnace at higher levels, when the proportion of primary air varies between 40 and 65% of the total combustion air.

SUMMARY OF THE INVENTION

The object of the present invention is to provide a method of combusting oil shale in a circulating fluidized bed boiler.

More particularly, the object of the present invention is to provide a method of reducing the tendency of fouling of heat transfer surfaces while combusting oil shale in a circulating fluidized bed boiler.

Another object of the present invention is to reduce chlorine corrosion while combusting oil shale in a circulating fluidized bed boiler.

In order to achieve these and other objects of the present invention, a new method is provided, as described in the claims.

Especially, according to the present invention, a method of combusting oil shale in a circulating fluidized bed boiler is provided, the method comprising the steps of (a) introducing oil shale into a furnace of the circulating fluidized bed boil, (b) introducing primary oxygenous gas through a bottom grid of the furnace, and (c) introducing secondary oxygenous gas to the furnace at a first level above the level of the bottom grid, wherein, the primary oxygenous gas is introduced to the furnace at a rate providing a fluidizing velocity of less than about 2.5 m/s below the first level.

According to the present invention, a fluidizing velocity, preferably, of less than about 2.5 m/s, even more preferably, of less than about 2.0 m/s, is used at the lowest portion of the furnace. It has surprisingly been noticed that such a very low fluidizing velocity provides optimal behavior of the bed when combusting oil shale. A low fluidizing velocity is advantageous in order to avoid excessive attrition of the fuel, and to avoid fouling of heat transfer surfaces in the flue gas path, as well as corrosion related to the fouling.

According to the present invention, the total rate of introducing gas to the furnace is advantageously such that, in the upper portion of the furnace, the fluidizing velocity is less than about 4.0 m/s, preferably, between 3.0 m/s and 4.0 m/s. This low fluidizing velocity in the upper portion of the furnace is advantageous to avoid excessive amounts of small particles from escaping from the furnace to foul heat exchange surfaces in the flue gas path downstream of the furnace.

Preferably, the proportion of primary combusting air is less than 40% of the total combusting air introduced to the furnace. More preferably, the proportion of primary combusting air is less than 38%, most preferably, from 35% to 38%, of the total combusting air.

Advantageously, the fuel is crushed to an average particles size of about 1 mm to about 2 mm. Preferably, 90% of the introduced fuel particles are of a size smaller than 10 mm, and 100% smaller than 20 mm. Oil shale particles have a low density, and they do not, when combusted, reduce in size as do typical fuel particles. Instead, they form porous particles which can be fluidized with very low fluidization velocities. Correspondingly, the introduced oil shale particles are advantageously of the above-mentioned optimal size, in order to avoid excessive escaping of bed particles from the furnace, as well as an increased amount of uncombusted carbon in the ash.

An advantage of combusting oil shale is that the fuel comprises, abundantly, calcium carbonate, $CaCO_3$ to convert, after being calcined to calcium oxide CaO, the sulfur in the fuel to calcium sulfate $CaSO_4$, thus preventing sulfur oxide $SO_2$ emissions to the environment. However, while the calcination is an endothermic reaction, it is advantageous to prevent excess calcination in the furnace. Moreover, it has been observed that the high tendency of attrition of oil shale is partly related to the calcination reaction. Therefore, it has been noticed that the fouling of the heat transfer surfaces decreases when the calcination of $CaCO_3$ is limited by keeping the temperature in the furnace relatively low. The temperature in the furnace is preferably maintained within the range of about 600 degrees Celsius to about 820 degrees Celsius, even more preferably, within the range of about 600 degrees Celsius to about 800 degrees Celsius.

BRIEF DESCRIPTION OF THE DRAWING

The above brief description, as well as further objects, features and advantages of the present invention will be more fully appreciated by reference to the following detailed description of the currently preferred, but nonetheless illustrative, embodiments in accordance with the present invention, when taken in conjunction with the accompanying drawing, wherein.

DETAILED DESCRIPTION OF THE PREFERRED EMBODIMENTS

Figure 1:
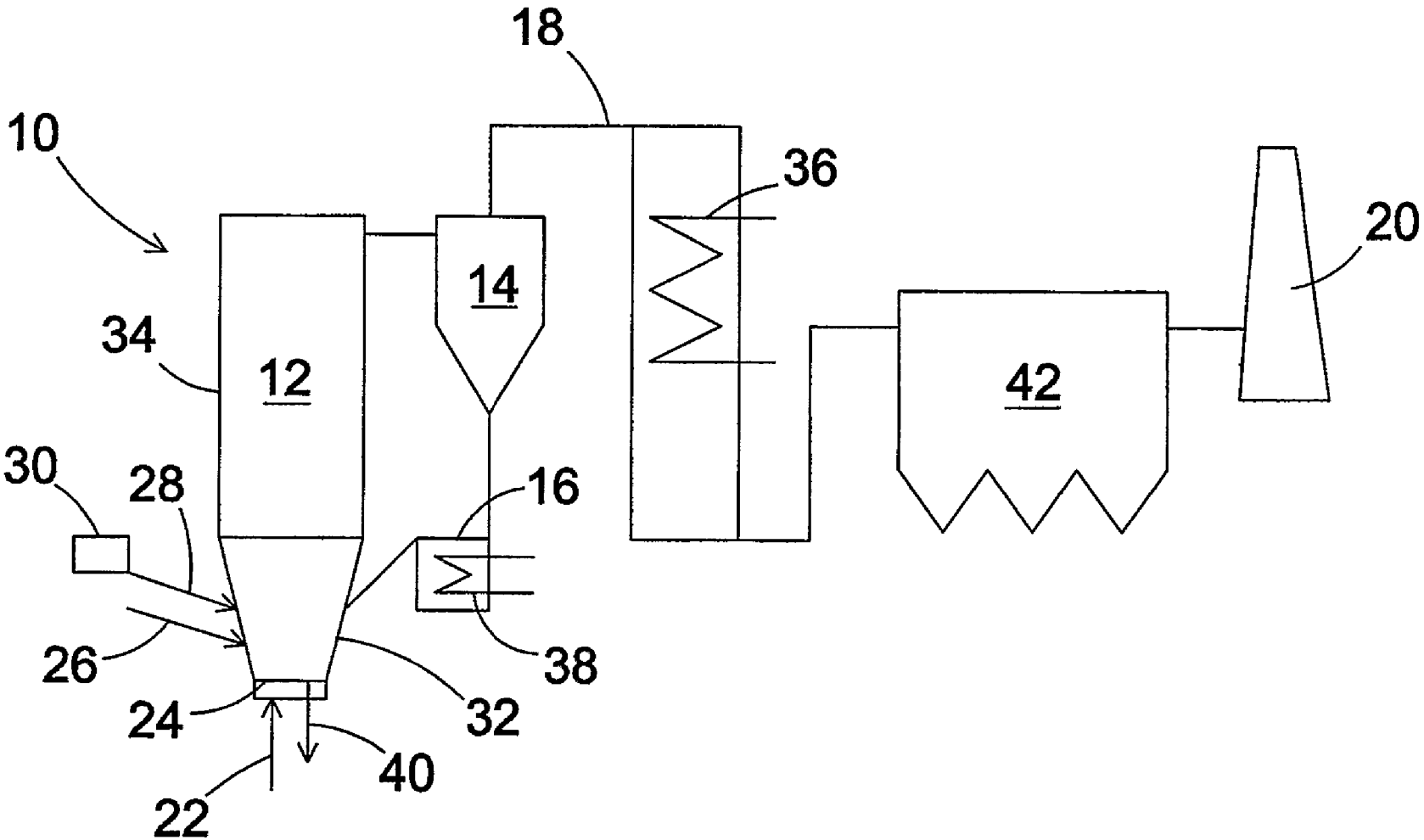
FIG. 1 is a schematic, vertical, cross-sectional view of a CFB boiler according to the present invention.

FIG. 1 shows schematically a CFB boiler 10 comprising a furnace 12, a cyclone separator 14, an external heat exchange member 16 and a flue gas channel 18 for leading flue gases through a stack 20 to the environment. The furnace comprises means 22 for introducing primary air through a bottom grid 24, and means 26 for introducing secondary air at a higher level of the furnace. Secondary air can be introduced at multiple levels, but for the sake of simplicity, they are not shown in FIG. 1.

The furnace comprises means 28 for introducing fuel, which, when using the present invention, is preferably oil shale. The fuel may alternatively be another fuel which has similar properties as those of the oil shale. Advantageously, the fuel is introduced to the furnace pneumatically. The means 28 for introducing fuel may comprise means 30 for crushing the fuel to a predetermined particle size. Preferably, oil shale is crushed to a mean particle size of 1 to 2 mm. In order to minimize uncombusted carbon in the ash, the size of the largest particles fed to the furnace should preferably not exceed 20 mm.

The present invention is related to avoiding excessive attrition of the oil shale in the furnace 12 by keeping the fluidizing velocity in the furnace low enough, preferably, less than 2.5 m/s at the bottom portion of the furnace and less than 4.0 m/s at the higher levels of the furnace. Preferably, the fluidization velocity at the bottom portion is less than 70%, even more preferably, less than 65% of the fluidization velocity at the upper portion of the furnace. In some cases, the fluidization velocity at the bottom portion is advantageously only about 50% of the fluidization velocity at the upper portion of the furnace.

In order to keep the fluidizing velocity in the bottom section of the furnace clearly lower than that in the higher levels of the furnace, the ratio of the primary air to secondary air is maintained to be low enough. Additionally, or alternatively, the ratio of the bottom area of the furnace to the cross-sectional area of the furnace at higher levels of the furnace is high enough.

According to a preferred embodiment of the present invention, the bottom section of the furnace 12 is downwards tapering, being about 60% of the cross-sectional area at the higher levels of the furnace. Preferably, when using such a furnace design, a fraction, from about 35% to about 38% of the combustion air, is introduced to the furnace as primary air. If the tapering of the bottom section is steeper, the proportion of the primary air is correspondingly smaller. If the tapering is shallower, the proportion of primary air can be correspondingly larger.

When only a small proportion of the combustion air, for example, 35%, is introduced as primary air, correspondingly, a large proportion, for example, 65%, is introduced as secondary air. When combusting oil shale, it has been found to be advantageous to introduce most of the secondary air as a carrying gas in a pneumatic fuel feed system. Advantageously, several pneumatic fuel feed points, preferably, at least six, even more preferably, at least eight, are used. Thereby, a rapid mixing of the fuel with oxygen and their even distribution to the furnace are obtained, both of which are desirable in order to obtain efficient combustion of oil shale and a low level of emissions to the environment.

The walls 34 of the furnace 12 are made of tube panels so as to evaporate feed water to steam. The steam is superheated in heat transfer surfaces 36, 38, which are located in the flue gas channel 18 and external heat exchange chamber 16, respectively. Preferably, the final superheating of the steam is performed in the heat exchange chamber 16, where the corrosion of the heat transfer tubes is minimized.

The furnace 12 and the heat transfer surfaces 36, 38 are advantageously designed for a relatively low furnace temperature, preferably, between 600 degrees Celsius and 820 degrees Celsius, even more preferably, between 600 degrees Celsius and 800 degrees Celsius. Thereby, the high temperature corrosion, especially chlorine corrosion, of the tube walls 34 of the furnace 12 and the heat transfer surfaces 36, 38 is reduced.

The bottom of the furnace 12 comprises means 40 for removing bottom ash from the furnace. A dust generator 42 for removing fly ash from the flue gas is disposed to the flue gas channel 18. The flue gas may also comprise other means (not shown) for cleaning the flue gas before it is discharged to the environment.

While the invention has been described herein by way of example in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

We claim:

1. A method of combusting oil shale in a circulating fluidized bed boiler, the method comprising the steps of:

(a) introducing fuel, comprising oil shale, into a furnace of the circulating fluidized bed boiler;

(b) introducing primary oxygenous gas through a bottom grid of the furnace; and (c) introducing secondary oxygenous gas to the furnace at a first level above the level of the bottom grid, wherein (i) the primary oxygenous gas is introduced to the furnace at a rate providing below the first level a fluidizing velocity of less than 2.5 m/s, (ii) the primary and secondary oxygenous gases are introduced to the furnace in such a way that a circulating fluidized bed is formed, (iii) the fluidizing velocity at the first level is less than 70% of the fluidizing velocity in the upper portion of the furnace, and (iv) the proportion of the primary oxygenous gas is less than 40% of total oxygenous gas introduced to the furnace.

2. A method in accordance with claim 1, wherein the primary oxygenous gas is introduced to the furnace at a rate providing a fluidizing velocity of less than 2.0 m/s below the first level.

3. A method in accordance with claim 1, wherein the primary and secondary oxygenous gases are introduced to the furnace at a rate providing a fluidizing velocity of less than 4.0 m/s in the upper portion of the furnace.

4. A method in accordance with claim 1, wherein the primary and secondary oxygenous gases are introduced to the furnace in such a way that the fluidizing velocity, below the first level, is less than 65% of the fluidizing velocity in the upper portion of the furnace.

5. A method in accordance with claim 1, wherein the fuel introduced to the furnace has an average particle size, in diameter, of one mm to two mm.

6. A method in accordance with claim 1, wherein the proportion of the primary oxygenous gas is less than 38% of the total oxygenous gas introduced to the furnace.

7. A method in accordance with claim 6, wherein the proportion of the primary oxygenous gas ranges from 35% to 38% of the total oxygenous gas introduced to the furnace.

8. A method in accordance with claim 1, wherein the temperature in the furnace is maintained within the range of 600 degrees Celsius to 820 degrees Celsius.

9. A method in accordance with claim 8, wherein the temperature in the furnace is maintained within the range of 600 degrees Celsius to 800 degrees Celsius.

* * * * *